United States Patent [19]

Berkowitz

[11] Patent Number: 4,586,935

[45] Date of Patent: May 6, 1986

[54] METHOD OF PREPARING COAL TO INCREASE ITS CALORIFIC VALUE AND MAKING IT SAFE FOR STORAGE AND TRANSPORT

[75] Inventor: Norbert Berkowitz, 6605-124 St., Edmonton, Alberta, Canada, T6H 3V4

[73] Assignees: Meridian Petroleums Ltd., Calgary; Norbert Berkowitz, Edmonton, both of Canada; a part interest

[21] Appl. No.: 692,190

[22] Filed: Jan. 17, 1985

[30] Foreign Application Priority Data

Sep. 21, 1984 [CA] Canada ..... 462511

[51] Int. Cl.[4] ..... C10L 9/08; C10L 9/10

[52] U.S. Cl. ..... 44/1 R; 44/6; 34/9

[58] Field of Search ..... 44/1 R, 1 SR, 1 G, 6; 34/9

[56] References Cited

U.S. PATENT DOCUMENTS

| | | | |
|---|---|---|---|
| 1,912,697 | 6/1933 | Fife | 44/6 |
| 2,176,127 | 10/1939 | Fife | 44/6 |
| 2,184,621 | 12/1939 | Marmaduke | 44/6 |
| 2,319,942 | 5/1943 | Miller | 44/6 |
| 3,779,722 | 12/1973 | Tatum | 44/1 SR |
| 3,909,213 | 9/1975 | Sanders | 44/1 SR |
| 3,961,914 | 6/1976 | Kindig et al. | 44/1 R |
| 4,214,875 | 7/1980 | Kromrey | 44/6 |
| 4,244,700 | 1/1981 | Chukhanov et al. | 44/1 R |
| 4,331,445 | 5/1982 | Burns | 44/6 |
| 4,396,394 | 8/1983 | Li et al. | 44/1 R |
| 4,421,520 | 12/1983 | Matthews | 44/6 |

FOREIGN PATENT DOCUMENTS

| | | | |
|---|---|---|---|
| 158537 | 8/1954 | Australia | 44/1 R |
| 25883 | 2/1984 | Japan | 44/1 R |
| 321969 | 11/1929 | United Kingdom | 44/1 R |

*Primary Examiner*—Carl F. Dees

*Attorney, Agent, or Firm*—Saidman, Sterne, Kessler & Goldstein

[57] ABSTRACT

There is described an improved method for treating low rank coal to lessen the risk of autogenous heating and attendant combustion hazards by means of passing the coal through a bath of molten metal to elevate its temperature into the range Td to Td+50° C., where Td is the temperature of decomposition of the coal.

22 Claims, 3 Drawing Figures

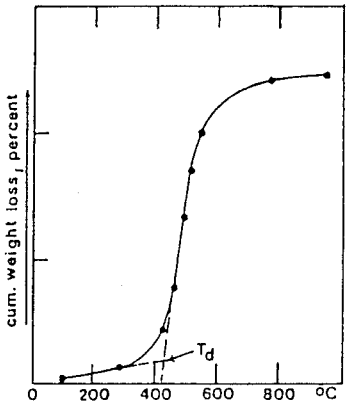
FIG. 1
FIG. 2
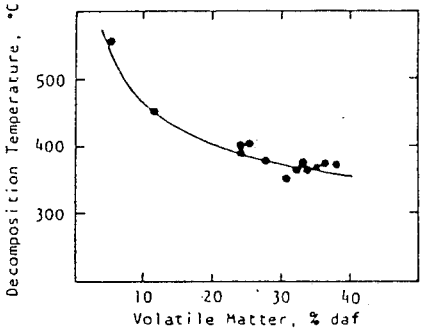
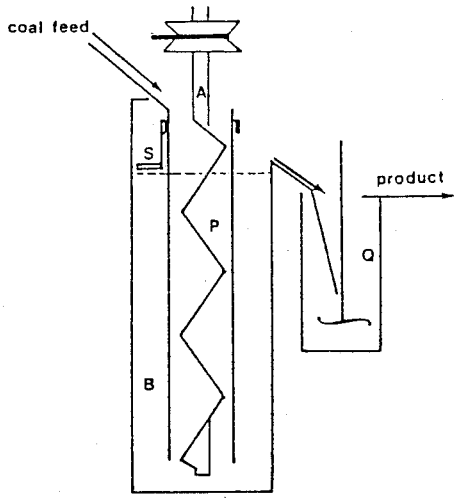
FIG. 3

METHOD OF PREPARING COAL TO INCREASE ITS CALORIFIC VALUE AND MAKING IT SAFE FOR STORAGE AND TRANSPORT

BACKGROUND OF THE INVENTION

This invention relates to a method of preparing coal for safe storage and transport and simultaneously improving its fuel value. More particularly it relates to a method of heat-treating coal which involves passing it through a molten metal bath to produce a solid fuel that possesses a higher heating value and can be stored or transported without posing potentially serious combustion hazards and associated economic losses through excessive autogenous heating.

When exposed to the atmosphere, freshly mined low-rank coals—especially those classed as lignites and subbituminous coals—will rapidly chemisorb oxygen and consequently, even when held in compacted stockpiles through which relatively little air can circulate freely, tend to heat up until igniting. The same is true of chars prepared from such coals by conventional carbonization at temperatures below −700° C. Commonly referred to as "spontaneous" or (more correctly) "autogenous" heating, this presents a serious hazard whenever substantial tonnages of low-rank coals are stockpiled or transported in open freight cars or in ships' holds.

The primary cause of autogenous heating lies in air-oxidation of the coal, which converts its organically-bound carbon into carbon dioxide with an ultimate heat release of 395 kJ per mole. If the coal contains a relatively high proportion (say, more than 1%), of inorganic sulphur, autogenous heating can also arise from oxidation of pyrite, which is believed to cause formation of a pyrophoric ferrous sulphate as an intermediate reaction product (cf. Mapstone, G. E.; 1954. Chem. Ind. (London), 658) and which ultimately liberates some 840 kJ per mole. Since oxidation rates will approximately double with each 10° C. rise in temperature, these heat releases, if not quickly dissipated into the surrounding air, will promote a self-accelerating oxidation process and cause the coal to heat up progressively more quickly toward its ignition temperature.

However, at normal ambient temperatures, carbon oxidation rates are too small to initiate this sequence, and it is therefore also generally accepted that autogenous heating is in practice triggered by heat released when a dry or partly dried coal is wetted by water. Such "heats of wetting" will, in other words, raise the temperature of the coal to levels at which the carbon oxidation rates can eventually lead to ignition. This mechanism, first proposed by Berkowitz and Schein (1951) Fuel, 30, 94, on the basis of laboratory measurements of heats of wetting, has been confirmed by others (cf., for example, Hodges & Hinsley, 1963, Trans. Inst. Min. Engrs., 123, 211; Hodges & Acherjee, 1966, ibid., 126,121; Battacharyya et al, 1969, Min. Engng., 101, 274; Guney, 1971, Bull. Can. Inst. Min. Metall., 64, 138; and Shea & Hsu, 1972) and is independently supported by observations on bulk storage piles. For example, Erdtmann & Stoltzenberg (1908) Braunkohle, 7, 69; Threllfall (1909) and Hoskins (1928), Purdue Univ. Expt. Stn., Bull. No. 30, among many others, have reported that autogenous heating commonly begins (1) after rain following a period of dry sunny weather, (2) when dry coal is placed on wet ground, or (3) when wet coal is loaded onto an established, partially dried-out stockpile. In the latter cases, heating invariably begins at the interface between wet and dry material.

There does not yet exist a definitive laboratory test for determining whether a particular coal is likely to pose significant hazards through autogenous heating. However, since heats of wetting under otherwise similar conditions are proportional to the extent of the wetted surface (which is in turn proportional to the porosity of the coal), most authorities agree that the probability of autogenous heating is statistically related to the "capacity" moisture (or "bed" moisture) content of coal. This parameter is defined as the amount of water which a coal will hold when in equilibrium with air at 98% relative humidity—i.e. when fully water-saturated; it directly reflects the porosity of the coal; and, like the porosity, decreases rapidly with increasing rank (from over 30% among lignites to 18–22% among subbituminous coals and less than 10% among bituminous coals).

Like conclusions from laboratory observations on the effect of wetting of dry or partly dried coal on oxidation rates, this inference, too, is confirmed by practical experience. Hazards from autogenous heating decrease rapidly with increasing rank and only pose serious problems among lignites and subbituminous coals. High volatile bituminous and coals of higher rank are not, as a general rule, subject to significant autogenous heating; and it follows therefore that a lignite or subbituminous coal (with 35% and 20% bed moisture content, respectively) could be rendered relatively "safe" by procedures which, without causing chemical changes that enhance their reactivity toward oxygen, permanently reduce its capacity moisture content to, say, less than 10–12%.

SUMMARY OF THE INVENTION

The present invention is intended to provide a procedure which minimizes the liability of low-rank coals to autogenous heating and, consequently, allows such coals to be safely stored and/or transported.

Another objective is the provision of a treatment which lowers the surface area or pore volume of a coal accessible to moisture or oxygen, and therefore lowers heats of wetting as well as rates of oxidation.

A further objective of the invention is a permanent reduction of the capacity moisture content of the coal in order to not only reduce hazards from autogenous heating, but also to facilitate more economical transportation because of the lower moisture content and higher heating value of a given quantity of coal.

These and other objectives of the invention are achieved by a treatment which comprises briefly heating the coal in molten metal to a temperature not much higher than 30° to 50° C. above its formal "decomposition temperature" Td, and then quickly cooling it to room temperature by quenching it in water or any other suitable medium. For the purposes of this invention the decomposition temperature is defined as the temperature at which the rate of weight loss of the coal first attains maximum value. At this temperature, which depends upon coal rank and petrographic composition, the coal begins to generate considerable amounts of volatile pyrolytic material which normally diffuses out from the coal and condenses as tarry matter. If, therefore, the coal is heated in a manner which prevents or substantially retards the escape of "volatile material" from the coal, this tarry matter will, upon quenching of the coal, form self-solidifying plugs in the finer pores of the coal, and consequently render a greater proportion of the total pore volume inaccessible to water, oxygen and other like substances.

According to the present invention, then, there is provided a method of treating low-rank coal to lessen the risk of autogenous heating and attendant combustion hazards, comprising the step of passing the coal through a bath of molten metal to elevate the temperature of the coal into the range Td and Td+50° C., where Td is the decomposition temperature of the coal.

According to a further aspect of the present invention, there is also provided a method of reducing the capacity moisture content of low-rank coal, comprising the steps of heating the coal in a bath of molten metal to a temperature at which volatile pyrolytic tarry material is generated within the coal, retarding the escape of the pyrolytic material from the coal, and quickly cooling the coal to cause condensation of the pyrolytic material in the pores thereof, the condensed pyrolytic material forming self-solidifying plugs in the pores to inhibit the ingress of water, oxygen and like physically and chemically active substances into a substantial proportion of the pores.

It is known from the inventor's earlier Canadian Pat. No. 959,783 dated Dec. 24, 1974 to treat the coal using hot oil as the heating medium. It has been found however that the use of hot oil presents some potentially significant problems. Suitable oils possessing the required chemical stability at the required processing temperatures are very difficult to obtain. More importantly, regardless of their stability, most oils tend to fume excessively at operating temperatures, resulting in the need for frequent replenishment and the creation of potential fire hazards. Furthermore, although the quantities of oil adhering to the processing coal are small, subsequent atmospheric oxidation of the adhering oil has been found in some instances, particularly in the case of very low ranking lignites, to promote autogenous heating, and also to cause sticking or caking of the processed coal in the burner nozzles through which the coal is fed into industrial boilers. It has been found that each of these problems is overcome by means of use of a metal bath.

BRIEF DESCRIPTION OF THE DRAWINGS

Embodiments of the invention will now be described in greater detail and will be better understood when read in conjunction with the following drawings in which:

FIG. 1 illustrates how the cumulative weight loss of a coal increases with temperature, and identifies the decomposition temperature Td;

FIG. 2 shows how Td tends to vary with coal rank; and

FIG. 3 illustrates schematically an apparatus for passing coal through a molten metal bath.

An important requirement for effective treatment is that the temperature at which the coal is processed is not so high nor the treatment time so long as to cause substantial loss of tarry matter. For most coals, this implies a processing temperature between Td and Td+30° C., or perhaps between Td and Td+50° C. in some rarer instances, and a processing time which, while depending upon the nature and average lump (or particle) size of the feed coal, lies usually between 5 and 30 minutes.

A suitable medium for processing coal in accordance with this invention is any metal or metal alloy which forms a macroscopically homogenous "melt" at temperatures at least 10° to 20° C. below Td, but still has a relatively low vapour pressure at temperatures up to Td+50° C. A lower melting range for the metal is acceptable, provided that it is not so low as to result in excessive metal vapour pressure at the processing temperature. Excessive metal vapour pressures could lead to a loss of metal from the bath and potentially to undesirable penetration of metal into the coal.

Examples of suitable metals are lead and lead-tin alloys.

EXAMPLE

FIG. 3 illustrates schematically, without affecting the generality of the foregoing, the manner in which the objectives of the invention can be accomplished.

In this scheme, an auger A feeds the suitably crushed (say, minus 1.25 cm) coal downward through pipe P which is vertically centered in an externally-heated metal bath B, and coal discharged into the bath at the bottom, having a much lower specific gravity than the molten metal, then drifts rapidly to the top from where it is taken off by a continuous skimmer S and transferred to a quench Q. Since some processing occurs while the coal moves down through pipe P, the optimum total processing time can be regulated by controlling the augering speed (which governs the rate at which coal travels through pipe P) as well as by adjusting the pitch of optional outer vanes (not shown) on pipe P (which governs the rate at which the coal can move up to the skimmer).

Other means of controlling the duration of the heating time will occur to those skilled in the art and it is contemplated that such other means may be adapted without departing from the inventive scope of the present invention.

Where so desired, an appropriately conditioned "heavy medium" unit of the type commonly used to "clean" coal can be substituted for a simple water quench in order to reduce the ash content of the processed coal.

Laboratory tests in a device substantially similar to the apparatus illustrated in FIG. 3 have shown that treatment under optimum operating conditions can permanently lower the capacity moisture contents of lignites from some 32% to as little as 11 or 12%, and similarly reduce the capacity moisture contents of subbituminous coal from 18 to 19% to as low as 8–9%. In all cases, the heat treatments by which these reductions were brought about were also observed to effect a substantial increase in the calorific value of the coal. Table 1, attached, exemplifies these findings

TABLE 1

| | capacity moisture content (%) after heating | | |
|---|---|---|---|
| | 1 min | 5 min | 15 min |
| 1. Saskatchewan lignite ($31.84 \pm 0.8\%$ $H_2O$) | | | |
| treated at 375° C. | — | $13.68 \pm 0.97$ (6) | $12.31 \pm 0.69$ (6) |
| 390° C. | $16.81 \pm 0.27$ (3) | $13.38 \pm 0.92$ (4) | $12.52 \pm 0.35$ (6) |
| 410° C. | $16.77 \pm 0.41$ (3) | $12.56 \pm 0.08$ (4) | $11.53 \pm 0.08$ (6) |

TABLE 1-continued

| | capacity moisture content (%) after heating | | |
|---|---|---|---|
| | 1 min | 5 min | 15 min |
| 2. Alberta subbituminous coal ($19.82 \pm 0.85\%$ $H_2O$) | | | |
| treated at 390° C. | 16.73 ± 0.18 (3) | 13.75 ± 0.24 (6) | 11.20 ± 0.49 (6) |
| 410° C. | 14.73 ± 0.75 (3) | 13.20 ± 0.56 (6) | 12.39 ± 0.80 (6) |
| 425° C. | 15.04 ± 0.83 (3) | 12.50 ± 1.06 (6) | 10.21 ± 0.48 (6) |

Note:
numbers in parentheses show the number of replicate tests. variations within any one set are attributed to slightly different size consists of samples (and hence to slightly different heating rates)
Calorific values (expressed on dry, ash-free basis to show "real" upgrading effect):
Saskatchewan lignite: untreated 10 745 btu/lb
treated (5 min/410° C.) 12 140 btu/lb
Alberta subbit. coal: untreated 11 353 btu/lb
treated (5 min/425° C.) 12 710 btu/lb The embodiments of the invention in which an exclusive property or privilege is claimed are defined as follows:

1. A method of treating low-rank coal to lessen the risk of autogenous heating and attendant combustion hazards, comprising the step of passing said coal through a bath of molten metal to elevate the temperature of said coal into the range Td to Td+50° C., where Td is the decomposition temperature of said coal.

2. The method of claim 1 including the additional step of rapidly quenching the coal in a liquid medium, said heating of the coal causing the formation of volatile pyrolytic material in the pores thereof, said rapid quenching causing said pyrolytic materials to condense in said pores to form self-solidifying plugs therein which inhibit the entry of water, oxygen and like substances into said pores.

3. The method of claim 2 wherein said molten metal has a specific gravity in excess of that of said coal.

4. The method of claim 3 wherein said molten metal melts to form a macroscopically substantially homogenous liquid phase at a temperature in the range at least 10° to 20° C. below the said decomposition temperature Td of said coal.

5. The method of claim 4 wherein the duration of treatment and the temperature of said molten metal are adjusted in accordance with the characteristics of said coal and the sizes of individual coal particles to be treated.

6. The method of claim 5 wherein the duration of treatment varies in the range of 5 minutes to 30 minutes.

7. The method of claim 6 wherein said molten metal is lead.

8. The method of claim 6 wherein said molten metal is an alloy of lead and tin.

9. The method of claim 1 wherein the temperature of said coal is elevated into the range Td to Td+30° C.

10. The method of claim 7 wherein the temperature of said coal is elevated into the range Td to Td+30° C.

11. The method of claim 8 wherein the temperature of said coal is elevated into the range Td to Td+30° C.

12. A method of reducing the capacity moisture content of low-rank coal, comprising the steps of:

heating said coal in a bath of molten metal to a temperature at which volatile pyrolytic tarry material is generated within the coal;

retarding the escape of said pyrolytic material from said coal; and quickly cooling said coal to cause condensation of said pyrolytic material in the pores thereof, said condensed pyrolytic material forming self-solidifying plugs in said pores to inhibit the ingress of water, oxygen and like physically and chemically active substances into a substantial proportion of said pores.

13. The method of claim 12 wherein said coal is heated in said bath of molten metal to a temperature in the range of Td to Td+30° C., wherein Td is the temperature of decomposition of said coal, and said molten metal acts to retard the escape of said pyrolytic material from said coal.

14. The method of claim 13 wherein the duration of heating of said coal is adjusted depending upon the type of coal and the size of coal particles being heated.

15. The method of claim 14 wherein said molten metal forms a macroscopically substantially homogeneous liquid phase at a temperature in the range at least 10° to 20° C. below the said decomposition temperature Td of said coal.

16. The method of claim 15 wherein said molten metal is one of lead and a lead-tin alloy.

17. The method of claim 16 wherein said coal is cooled in water.

18. The method of claim 16 wherein said coal is cooled in a heavy medium to reduce the ash content of the treated coal by gravity separation.

19. The method of claim 14 wherein the coal is added to the bottom of said bath of molten metal via a conduit passing through said molten metal, whereby the coal is at least partially heated while in said conduit, and said duration of heating is at least partially controlled by regulating the speed at which said coal is fed through said conduit.

20. The method of claim 19 wherein said coal floats to the top of said molten metal from whence it is skimmed off and transported to a quenching tank in which said cooling of the coal occurs.

21. The method of claim 20 wherein said coal is cooled in water.

22. The method of claim 21 wherein said coal is cooled in a heavy medium to reduce the ash content of the treated coal by means of gravity separation.

* * * * *